US009564724B2

(12) United States Patent
Ohnuki et al.

(10) Patent No.: US 9,564,724 B2
(45) Date of Patent: Feb. 7, 2017

(54) ELECTRICAL CONNECTOR

(71) Applicant: SOURIAU JAPAN K.K., Kawasaki-shi (JP)

(72) Inventors: Shigeru Ohnuki, Kawasaki (JP); Eiichiro Takizawa, Kawasaki (JP)

(73) Assignee: SOURIAU JAPAN K.K., Kawasaki-shi (JP)

( * ) Notice: Subject to any disclaimer, the term of this patent is extended or adjusted under 35 U.S.C. 154(b) by 0 days.

(21) Appl. No.: 14/779,696

(22) PCT Filed: Mar. 25, 2014

(86) PCT No.: PCT/JP2014/058269

§ 371 (c)(1),
(2) Date: Sep. 24, 2015

(87) PCT Pub. No.: WO2014/157194

PCT Pub. Date: Oct. 2, 2014

(65) Prior Publication Data

US 2016/0049758 A1 Feb. 18, 2016

(30) Foreign Application Priority Data

Mar. 27, 2013 (JP) ..... 2013-067540

(51) Int. Cl.
*H01R 4/66* (2006.01)
*H01R 25/00* (2006.01)
(Continued)

(52) U.S. Cl.
CPC ..... *H01R 25/00* (2013.01); *H01R 13/6593* (2013.01); *H01R 9/032* (2013.01)

(58) Field of Classification Search
CPC ..... H01R 13/65802; H01R 23/668; H01R 13/4532; H01R 9/092
(Continued)

(56) References Cited

U.S. PATENT DOCUMENTS 4,382,653 A 5/1983 Blanchard
4,990,104 A 2/1991 Schieferly
(Continued)

FOREIGN PATENT DOCUMENTS

JP 4-229577 A 8/1992
JP 05-217633 A 8/1993
(Continued)

OTHER PUBLICATIONS

International Search Report issued Jun. 10, 2014 in PCT/JP2014/058269 filed Mar. 25, 2014.
(Continued)

*Primary Examiner* — Phuongchi T Nguyen
(74) *Attorney, Agent, or Firm* — Oblon, McClelland, Maier & Neustadt, L.L.P.

(57) ABSTRACT

A connector including: an electrically conductive shell covering a signal wire of a communication cable; a clip formed by punching a plate; and a frame body covering both the electrically conductive shell grounded to the ground wire of a printed circuit board, and the frame body is grounded to a frame. A tab that can be cut off is formed on the clip. The tab is formed to electrically connect the electrically conductive shell and the frame body by contacting the frame body during assembling of the connector. When the tab of the clip is cut off during the assembling of the connector, the electrical connection between the electrically conductive shell and the frame body is interrupted. In the connector, a grounding mode connection to the printed circuit board and a grounding mode connection to the frame can be freely designed by cutting off the tab of the clip.

13 Claims, 8 Drawing Sheets

(51) Int. Cl.
*H01R 13/6593* (2011.01)
*H01R 9/03* (2006.01)

(58) Field of Classification Search
USPC ..... 439/95, 497, 108, 607.01, 143, 943
See application file for complete search history.

(56) References Cited

U.S. PATENT DOCUMENTS

| | | | | |
|---|---|---|---|---|
| 4,990,105 | A | 2/1991 | Karlovich | |
| 5,037,328 | A | 8/1991 | Karlovich | |
| 5,125,854 | A * | 6/1992 | Bassler | H01R 13/514 439/536 |
| 5,965,847 | A | 10/1999 | Tanaka et al. | |
| 6,916,205 | B1 * | 7/2005 | Kaneko | H01R 9/0524 439/607.42 |
| 7,217,372 | B2 * | 5/2007 | Kintz | F16F 9/006 252/62.52 |
| 7,445,471 | B1 | 11/2008 | Scherer et al. | |
| 2006/0246776 | A1 | 11/2006 | Itou et al. | |

FOREIGN PATENT DOCUMENTS

| | | | |
|---|---|---|---|
| JP | 10-144405 | A | 5/1998 |
| JP | 2003-234156 | A | 8/2003 |
| WO | 2011/058501 | A1 | 5/2011 |

OTHER PUBLICATIONS

Extended European Search Report mailed Oct. 21, 2016 in European Patent Application No. 14774590.5.

* cited by examiner

ELECTRICAL CONNECTOR

TECHNICAL FIELD

The present invention relates to an electrical connector for communication cables, and particularly relates to an electrical connector used for cables and the like that are sheathed with external conductors such as braiding.

BACKGROUND ART

In recent years, the environments of communication networks such as LANs that perform high-speed high-capacity data transmissions have not been limited to offices inside buildings, and the use of high-speed high-capacity data transmissions using communication cables such as Ethernet® cables has spread to harsh environments subjected to external influences, inside passenger aircraft, and to industrial fields such as inside factories, or inside railway cars.

Communication cables that are connected between communication devices have a structure wherein braiding is provided under a skin known as a sheath or jacket, and these cover paired wires (two sets of two or two sets of four) forming signal lines. The braiding has a shielding function of blocking external electromagnetic waves and a grounding function of connecting the ground lines between communication devices.

Regarding the grounding function of the braids, a certain grounding format may be required in the connectors when connecting certain devices via a communication cable with connectors attached at both ends thereof.

As the certain grounding format in the connectors, it is possible to conceive of two grounding formats, i.e. a grounding format wherein the braiding of the communication cable is connected to a ground line in a printed circuit board (hereinafter abbreviated to PCB) inside the communication device (hereinafter referred to as PCB grounding), and a grounding format wherein the braiding of the communication cable is connected to the external frame body of the connector which is in turn connected to a frame provided on a metallic box or the like housing the communication device (hereinafter referred to as frame grounding).

PCB grounding refers to a grounding format wherein the braiding of the communication cable is grounded by connection to the ground line of a PCB in the communication device, and frame grounding refers to a grounding format wherein the braiding of the communication cable is connected to the external frame body of a connector having the purpose of providing a shielding effect to block external noise, the external framework being in turn connected to a frame for grounding such as a metallic box housing the communication device or the like.

Additionally, when attaching a communication cable to a communication device via a connector in a harsh environment or in an industrial field, under the conventional art, for example, round connectors were used, one of which was installed on each of a plurality of cables, and the connectors were each coupled manually into a corresponding group of receptacle connectors mounted on a panel of the communication device.

SUMMARY OF THE INVENTION

Problems to be Solved by the Invention

Under these circumstances, in order to construct communication networks in harsh environments or in industrial fields, recent years have seen a demand for connectors capable of achieving various forms of grounding, adaptable to the presence or absence of PCB grounding between communication devices and to the presence or absence of frame grounding depending on the designs of the respective communication devices.

Furthermore, since conventional round connectors are installed on individual communication cables one at a time, when coupling them to corresponding receptacle connectors in communication devices, they needed to be manually coupled with the corresponding receptacle connectors in the panel of the communication device one at a time, so there was a problem in the connection productivity on site.

Additionally, since the connections are made by hand, there is a need to widely space the intervals between the corresponding receptacle connectors on the panel face of the communication device, so the counterpart receptacle connectors could not be placed efficiently within the limited area available on the panel.

Furthermore, there was also a demand for connectors such that when terminating connectors on site, the above-described grounding format does not become complicated and result in grounding errors.

Means for Solving the Problems

The present invention was made in consideration of the above-described problems, and has the purpose of collecting the individual connectors that were installed separately on each communication cable into single connectors in units of multiple communication cables, thereby providing a connector that improves the ease of the attachment work of communication cables to communication devices, efficiently arranges the communication cables within a prescribed area, and is adaptable to various grounding formats, and also providing specific conductor elements used in the assembly of such a connector.

(1) According to a preferred embodiment of the present invention, the connector of the present invention is capable of securing in a row a plurality of cables comprising a conductor line and a grounding conductor portion covering an outside portion of the conductor line, and preferably comprises:

a first conductive shell covering the conductor line without electrical contact and contacting the grounding conductor portion;

a conductive member comprising:

a plate-shaped base portion, a plurality of contact portions detachably conjoined to an edge portion of the base portion, and covering and contacting the grounding conductor portion of each cable, and a protruding piece extending from a surface of the base portion; and a conductive first frame body arranged to cover the conductive member and the first conductive shell;

wherein the frame body is electrically connected to the first conductive shell via the protruding piece, the contact portions and the grounding conductor portion.

(2) According to a preferred embodiment of the present invention, the connector of the present invention is such that when an arbitrary contact portion is detached from the base portion, a first conductive shell corresponding to the arbitrary contact portion is not electrically connected with the frame body.

(3) According to a preferred embodiment of the present invention, the conductive member of the connector of the present invention is attached to a non-conductive member for securing each cable, and when the contact portion is detached, the non-conductive member presses against the grounding conductor portion so as to electrically connect the grounding conductor portion and the first conductive shell.

(4) According to a preferred embodiment of the present invention, the present invention preferably is a pair of connectors comprising the connector of the above (1), and a counterpart connector corresponding thereto, having the conductive member of (1), wherein all of the contact portions are detached from the base portion; and when the pair of connectors is coupled, the first conductive shell is electrically connected to a ground line in a substrate by coming into contact with a second conductive shell provided on the counterpart connector that mates with the first conductive shell.

(5) According to a preferred embodiment of the present invention, the present invention preferably is a pair of connectors comprising the connector of the above (1), and a counterpart connector corresponding thereto, having the conductive member of (1), wherein the first frame body, by coming into contact with a second frame body provided on the counterpart connector, is electrically connected to a ground line different from the ground line in the substrate connected to the second frame body; and when the pair of connectors is coupled, the first conductive shell is not electrically connected to the ground line in the substrate due to not providing the second conductive shell in the counterpart connector mating with the first conductive shell, or removing the ground line of the second conductive shell.

(6) According to a preferred embodiment of the present invention, the present invention preferably is a pair of connectors comprising the connector of the above (1), and a counterpart connector corresponding thereto, having the conductive member of (1), wherein all of the contact portions are detached from the base portion; and when the pair of connectors is coupled, the first conductive shell is not electrically connected to the ground line in the substrate due to not providing the second conductive shell in the counterpart connector mating with the first conductive shell, or removing the ground line of the second conductive shell.

(7) According to a preferred embodiment of the present invention, the conductive member of the present invention is preferably used in a connector capable of securing in a row one or more cables comprising a conductor line and a grounding conductor portion covering an outside portion of the conductor line, and comprises:

a plate-shaped base portion, one or more contact portions detachably conjoined to an edge portion of the base portion, and covering and contacting the grounding conductor portion of each cable, and a protruding piece extending from a surface of the base portion.

Effects of the Invention (1) In order to achieve the above-mentioned purpose, the connector of the present invention is arranged so that the frame body is electrically connected to first conductive shells through the protruding piece, the contact portions and the grounding conductor portions, enabling a grounding format wherein all of the cables are arranged to have both a PCB ground and a frame ground that are electrically connected in common to the braiding.

(2) Furthermore, the connector of the present invention is arranged so that when an arbitrary contact portion is detached from the base portion, the first conductive shell corresponding to the arbitrary contact portion is not electrically connected to the frame body, so by removing contact portions that provide a common electrical connection between PCB ground and frame ground, a grounding format wherein an arbitrary cable is not frame grounded can be achieved.

Additionally, since the process of removing the contact portion can be easily performed by folding the contact portion and detaching it from the base portion of the conductive member, the assembly productivity of the connector can be improved.

(3) Furthermore, since the conductive member of the connector according to the present invention is attached to a non-conductive member for securing each cable, the cables can be precisely and stably secured at a predetermined spacing, for example, by clamping and securing each cable by a pair of non-conductive members.

Furthermore, since the connector according to the present invention is arranged so that the grounding conductor portions and the first conductive shells are electrically connected due to the non-conductive members pressing against the grounding conductor portions, a grounding format that reliably forms a PCB ground by means of the non-conductive members can be achieved.

(4) Furthermore, the pair of connectors of the present invention can be arranged so that all of the contact portions are detached from the base portion, so that there is no frame grounding, and when the pair of connectors is coupled, the first conductive shells mate with and contact second conductive shells provided on the counterpart connector mating with the first conductive shells, thereby achieving a grounding format in which there is only PCB grounding.

(5) Furthermore, the pair of connectors of the present invention can be arranged to have a conductive member according to (1), so that a first frame body is electrically connected to a ground line different from the ground line inside the substrate connected to the second frame body, and the first conductive shell is not electrically connected to the ground line inside the substrate, thereby achieving a grounding format that is only frame grounded for arbitrary cables.

(6) Furthermore, the pair of connectors of the present invention can be arranged so that all of the contact portions are detached from the base portion of the conductive member according to (1), and the first conductive shells are not electrically connected to the ground line in the substrate, so that there is neither PCB grounding nor frame grounding.

(7) Furthermore, the conductive member of the present invention is used in a connector capable of securing in a row one or more cables comprising a conductor line and a grounding conductor portion covering an outside portion of the conductor line, ad comprises a plate-shaped base portion, one or more contact portions detachably conjoined to an edge portion of the base portion, and covering and contacting the grounding conductor portion of each cable, and a protruding piece extending from a surface of the base portion.

As a result, the conductive member of the present invention can provide various grounding formats for the connector simply based on whether or not the contact portions are detached.

(8) Furthermore, the connector of the present invention is capable of securing in a row one or more cables comprising a conductor line and a grounding conductor portion covering an outside portion of the conductor line, enabling a plurality of cables to be positioned at a desired spacing so as to be able to efficiently arrange the connectors within the area of the panel on a communication device, and the cables can be collected on single connectors in units of a plurality of cables, enabling precise coupling to corresponding connectors by a single action.

MODES FOR CARRYING OUT THE INVENTION

Figure 1:
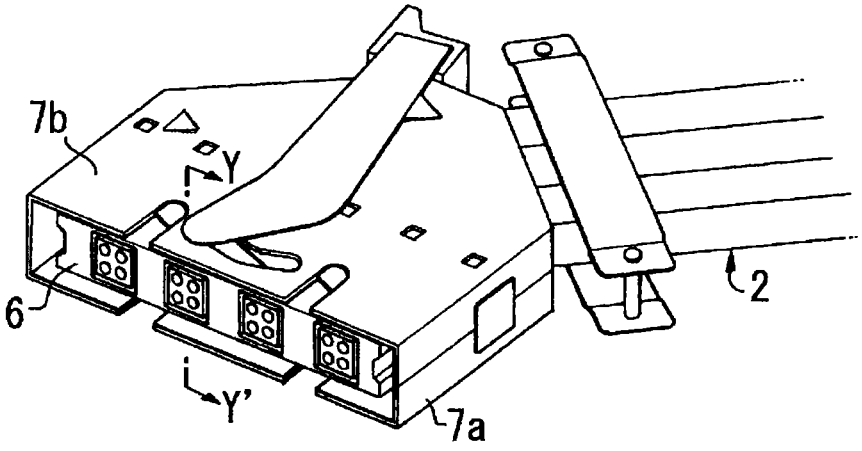
FIG. 1 is an assembled perspective view of a plug-type connector according to the present invention.

Preferred embodiments of the present invention will be explained by giving examples with reference to the drawings. In the drawings, the same reference numbers will be used to refer to the same elements, and their explanations may be omitted as appropriate.

In the present embodiment, a plug type connector is described as a connector to be installed on a communication cable, but those skilled in the art will readily recognize that it is also applicable to receptacle type connectors.

Additionally, in the present embodiment, the receptacle type connector to be coupled with the connector installed on the communication cable is assumed to be mounted on an edge portion of a substrate, but those skilled in the art will readily recognize that this can be applied to the case of coupling connectors both installed on communication cables.

Furthermore, in the specification of the present application, attachment of a communication device and a cable shall refer to the achievement of a predetermined electrical connection by coupling a pair of connectors, the coupling of one connector with a counterpart connector shall refer to connection of the two connectors to each other by a method such as mating or screwing, and installing a connector on a cable shall refer to attachment of a connector to the end portion of a cable after performing a predetermined termination process on the cable.

Figure 14:
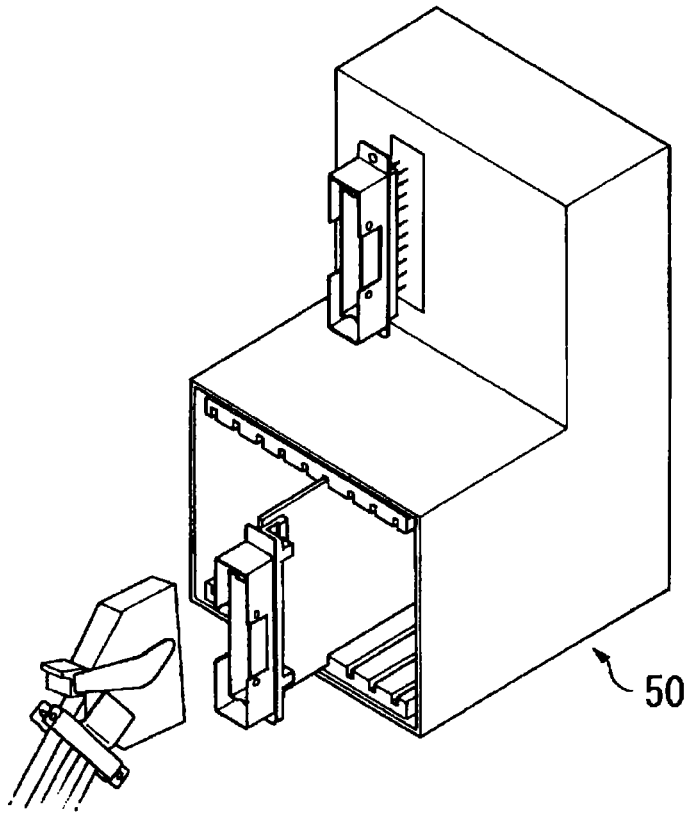
FIG. 14 shows a communication cable in a mounted state attached to a communication device.

FIG. 14 shows an example of a mounting format wherein a communication cable is attached to a communication device in a harsh environment or an industrial field.

The communication cable is connected, via the connector according to the present invention, to a counterpart connector mounted on the outer surface of a communication device housed in a metallic rack 50 or the like (in the panel mounting format shown at the top of FIG. 14) or to a counterpart connector mounted on a substrate inserted in a rack inside a communication device (in the rack panel format shown at the bottom of FIG. 14). The arrangement of the cables in the connector is such that they are arranged in a row with the most efficient spacing, and the receptacle connectors are efficiently arranged inside the area of the panel. This connector can be engaged and disengaged by a single action of a lever.

Herebelow, various grounding formats for the connector will be explained.

Example 1

In Example 1, a grounding format with both frame grounding and PCB grounding will be explained.

Figure 2:
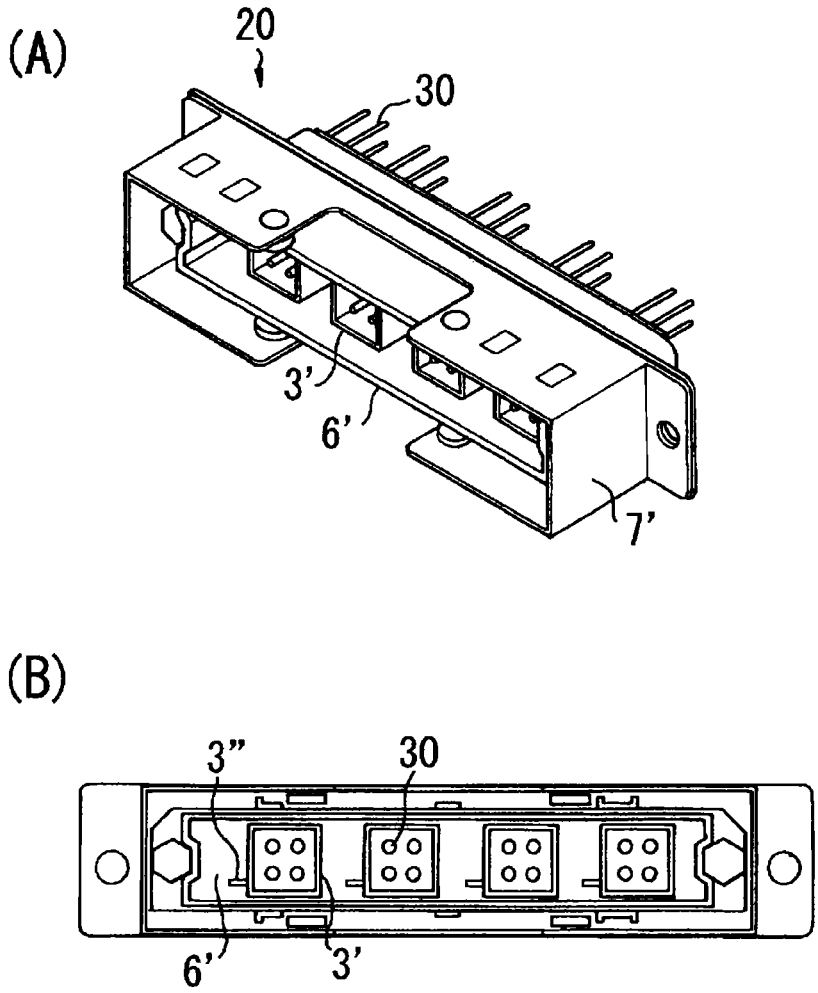
FIG. 2A is an assembled perspective view of a receptacle-type connector according to the present invention.
FIG. 2B is an assembled front view of a receptacle-type connector according to the present invention.

FIG. 1 is an assembled perspective view of a plug-type connector according to the present invention. FIG. 2A is an assembled perspective view of a receptacle-type connector according to the present invention, and FIG. 2B is an assembled front view of a receptacle-type connector according to the present invention.

Figure 3:
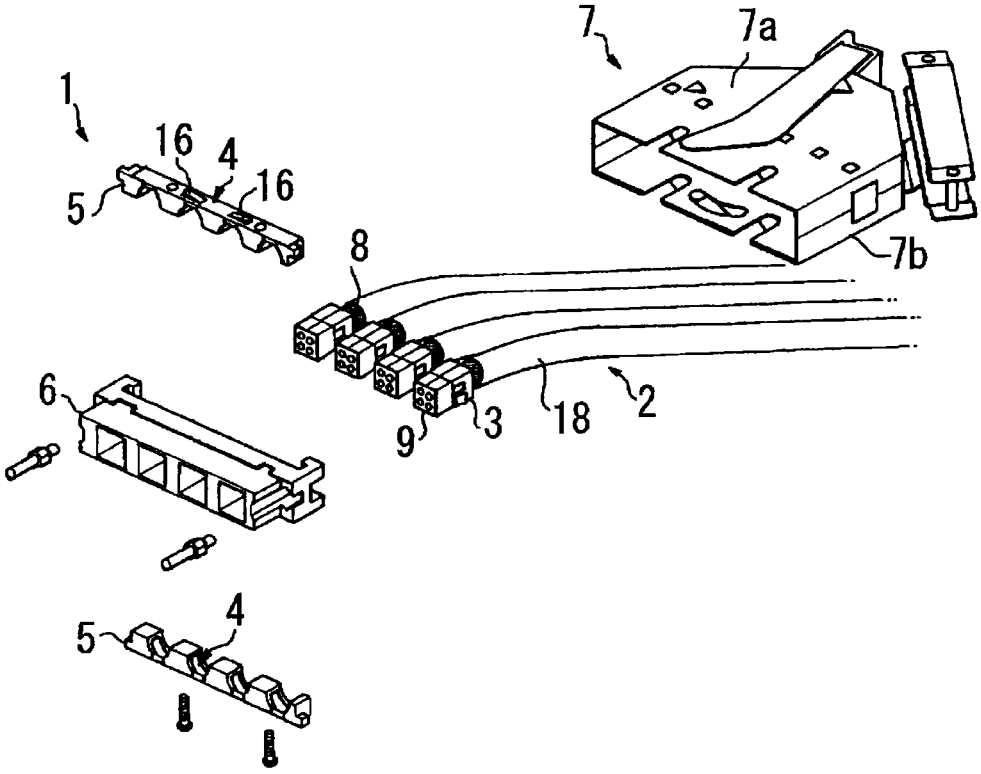
FIG. 3 is an exploded perspective view of the constituent elements of the connector according to the present invention.

FIG. 3 is an exploded perspective view of a plug-type connector. The structure of the plug-type connector 1 will be explained with reference to FIG. 3.

The plug-type connector 1 according to the present invention comprises a communication cable 2 of which one or a plurality may be arranged in a row (the drawing shows an example where there are four), conductive shells 3 consisting of a conductive metal (hereinafter referred to as a "shell"), a metallic grounding clip 4 which is a conductive element (hereinafter referred to as a "clip"), a resin block 5 consisting of a non-conductive element on which the clip 4 can be mounted, a plug body 6 capable of housing the shells 3, and a conductive frame body 7 capable of housing these inside.

Each communication cable 2 internally houses a plurality of paired lines (signal lines) for communication, the outer periphery of the paired lines is covered by braiding 8 forming a conductor portion for grounding, and the outer periphery of the braiding 8 is covered by an insulating outer skin 18.

Figure 4:
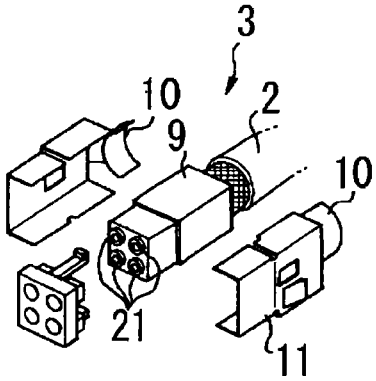
FIG. 4 is an exploded perspective view of a situation where four electrical lines of a communication cable are secured to the shell.

FIG. 4 is an exploded perspective view showing how the four paired lines in a single communication cable are terminated at the four contacts 21 and secured to the shell 3.

The shells 3 are configured to function so as to provide grounding to a PCB.

Additionally, as shown in FIG. 4, in one example, the shells 3 are each divided into halves, comprising securing portions 10 for holding one communication cable 2, and peripheral portions 11 that are coupled so as to clamp and cover an insulating insert 9 provided to hold the four paired lines in isolation.

Additionally, after being assembled to a state covering the periphery of the insulating inserts 9 holding the four contacts 21 of the communication cable 2, the shells 3 are not electrically connected to the contacts 21, but are electrically connected to the braiding 8 of the communication cables 2 via the securing portions 10.

Figure 5:
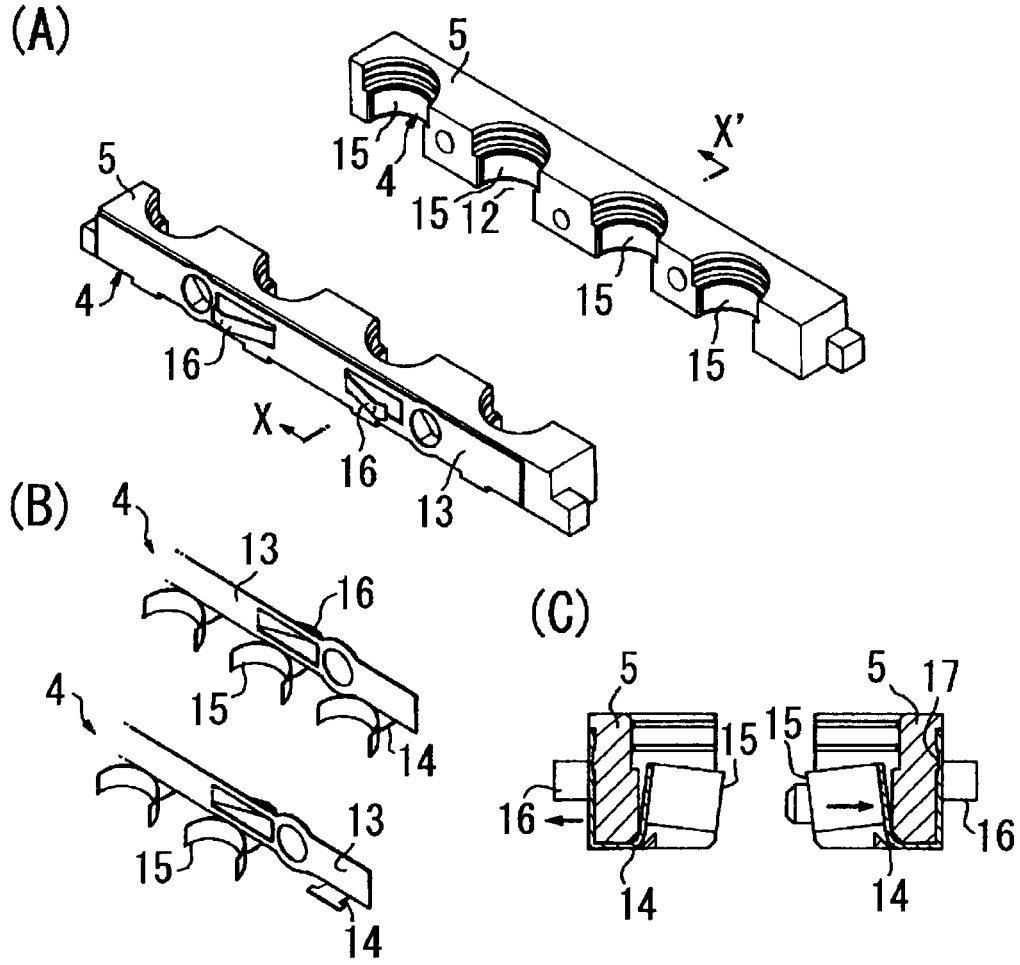
FIG. 5A is a perspective view of clips in a state of attachment to resin blocks.
FIG. 5B is a perspective view of clips.
FIG. 5C is a section view along X-X' of FIG. 5A.

FIG. 5A is a perspective view showing clips 4 mounted on resin blocks 5.

Figure 6:
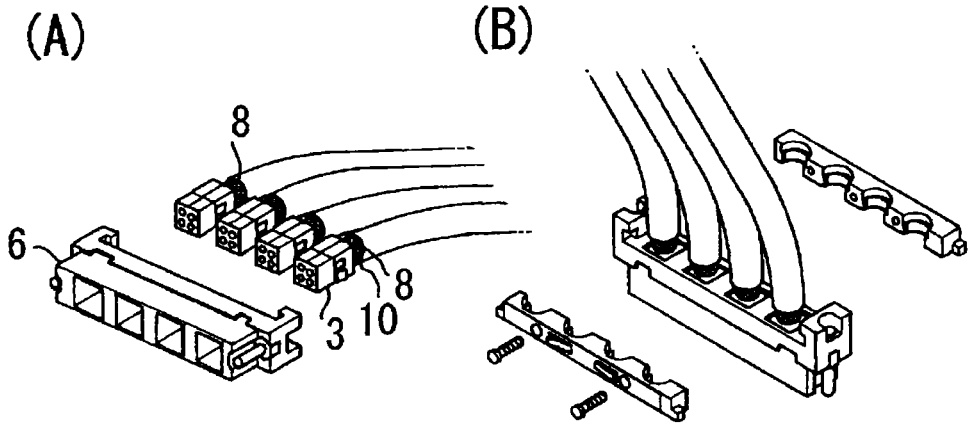
FIG. 6A shows the state after assembly of the shells shown in FIG. 4, and before inserting the shells into the plug body, with the braiding positioned at the securing portions of the shells.
FIG. 6B is a rear perspective view showing the state after inserting the shells into a plug body.

In one example, two clips 4 form one set, such that when mounted on counterpart resin blocks 5, they can grasp or secure communication cables 2 by clamping over the braiding 8 at concave portions 12 formed opposite each other (see FIG. 6B).

FIG. 5B is a perspective view of clips 4. The clips 4 consist of unitary conductive elements which can, for example, be formed by punching out a single plate.

The clip 4 comprises a plate-shaped base portion 13, extension portions 14 extending in a row from an edge portion of the base portion 13, arcuate portions 15 that are detachably connected and extending in an angled direction from the extension portions 14 so as to oppose one face of the plate-shaped base portion 13, and resilient protruding pieces 16 formed by cutting out the plate surface of the base portion 13 and shaping it into a cantilever in a direction opposite the arcuate portions 15.

The detachment between the extension portions 14 and the arcuate portions 15 can be performed, for example, by prearranging the portion to be detached so as to be thin, then folding or using cutting tools.

The extension portions 14 and the arcuate portions 15 are provided in a number corresponding to the one or more communication cables to be secured in positions aligned at a predetermined spacing. Additionally, the arcuate portions 15 form the aforementioned concave portions 12 along the concave portions of the resin block (see FIG. 5A).

The upper part of FIG. 5B shows the state with the arcuate portions not detached, and the lower part shows the state with the right-most arcuate portion 15 detached. Example 1 uses clips 4 in which the arcuate portions 15 are not detached as in the upper part of FIG. 5B.

FIG. 5C is a cross section along X-X' in FIG. 5A.

The clip 4 is secured by being detained to a claw portion 17 formed on one surface of the resin block 5.

The arcuate portions 15 are provided on one surface of the base portion 13, while the resilient protruding pieces 16 are provided on the other surface of the base portion 13, and the arcuate portions 15 and resilient protruding pieces 16 extend in opposite directions.

The arcuate portions 15 have gaps formed between the bottom portions of their parabolic faces and the block resin 5, and therefore have resilience with the extension portions 14 as base ends, and the cantilevered resilient protruding pieces 16 have resilience with the portions of conjunction with the plate surface of the base portion 13 as the base ends.

As such, the arcuate portions 15 and the resilient protruding pieces 16 have a return force that acts against a direction in which they are pressed.

FIG. 6A shows the state after assembly of the shells 3 shown in FIG. 4, wherein the shells 3 are inserted into the plug body 6 with the braiding 8 positioned at the securing portions 10 of the shells 3.

FIG. 6B is a rear perspective view showing the shells 3 after insertion into the plug body 6. In FIG. 6B, when the resin blocks 5 are clamped from opposite directions, the arcuate portions 15 inside the concave portions 12 press against the braiding 8 due to the resilient force thereof, thereby securing the communication cable 2.

As a result, the clip 4, braiding 8 and shells 3 can be reliably electrically connected.

Figure 7:
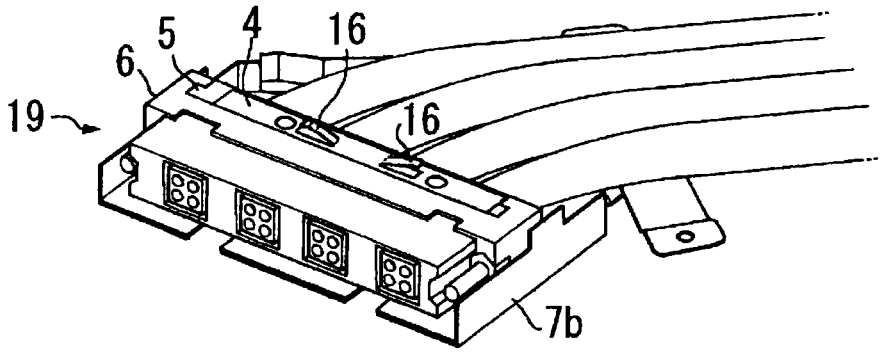
FIG. 7 shows how the shells, clips, resin blocks and plug body are assembled, then the assembly installed in the frame member.

FIG. 7 shows the shell 3, clip 4, resin block 5 and plug body 6 assembled, then the assembly 19 in the process of being installed in a frame body 7.

The frame body 7 is arranged to provide frame grounding.

Additionally, the frame body 7, in one example, is composed of two halves 7*a* and 7*b* (see FIG. 1 and FIG. 7), which are coupled so as to cover the assembly 19 by clamping from opposite directions.

When the frame bodies 7*a* and 7*b* are coupled as shown in FIG. 1, on the one hand, the arcuate portions 15 of the pair of opposing clips 4 press against the braiding 8 of the communication cable 2 from opposite directions to secure the communication cable 2 while achieving an electrical connection between the braiding 8 and the shells 3, and on the other hand, the resilient protruding pieces 16 of the clip 4 press against the frame bodies 7*a*, 7*b* with a return force against a pressing force from the inner surfaces of the opposing frame bodies 7*a*, 7*b*, thereby providing electrical connections.

As a result, the shells 3, which are PCB grounded when connected to a ground line on the substrate side, upon being electrically connected to the frame, are electrically connected via the clip 4 to the frame body 7 which provides frame grounding.

Figure 8:
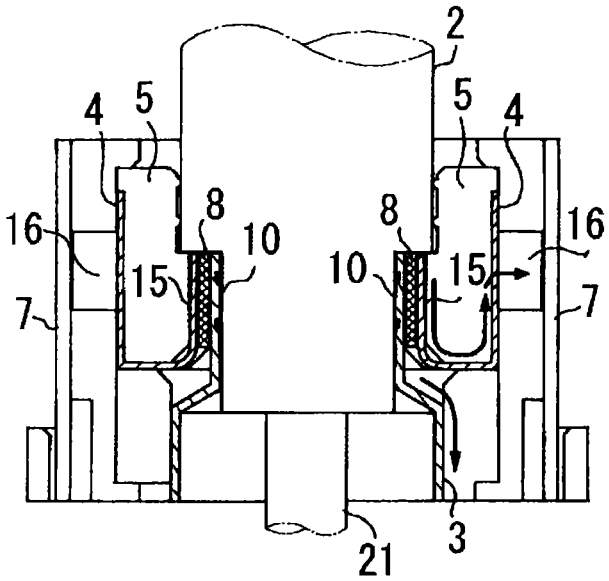
FIG. 8 is a horizontal section view along the line Y-Y' in FIG. 1.

FIG. 8 is a horizontal cross section along Y-Y' in FIG. 1 showing this state. The diagram shows that the braiding 8 for grounding is electrically connected to the frame body 7 through the clip 4 and to the shells 3 through the securing portion 10, thereby providing both PCB ground and frame ground.

Next, a receptacle-type connector 20 will be explained with reference to FIG. 2A and FIG. 2B.

The receptacle-type connector 20 is composed of a plug body 6', electrical lines or contacts 30 passing through the plug body 6', shells 3' that, when coupling with a plug-type connector 1, mate with the shells 3 of the plug-type connector and are electrically connected therewith, and a frame body 7' that mates with a frame body 7 of the plug-type connector 1 and is electrically connected therewith.

The electrical lines or contacts 30 are covered by the shells 3' installed on the plug body 6' and are connected to predetermined electrical wiring in a PCB. The shells 3' are connected to ground lines in the PCB through their ground lines 3" or the like, to provide PCB grounding. The frame body 7' is grounded to a frame of a metal rack 50 or the like housing a communication device as shown in FIG. 14 to provide frame grounding.

Figure 9:
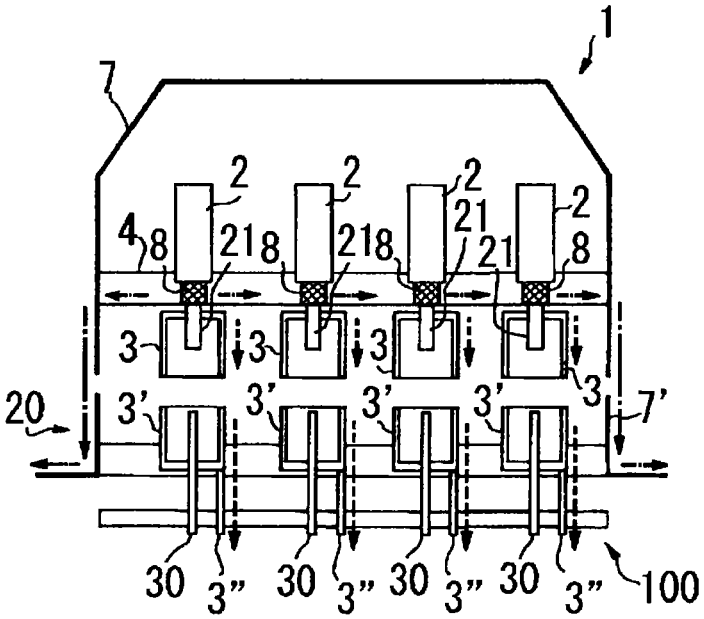
FIG. 9 is a schematic plan view showing the grounding format of Example 1.

FIG. 9 is a schematic plan view showing an example of an embodiment according to Example 1, in a grounding format wherein all of the communication cables are PCB grounded or frame grounded, in a cross section in the vertical direction at Y-Y' of FIG. 1 when the plug-type connector 1 and the receptacle-type connector 20 are coupled.

The braiding to form the ground lines is electrically connected as PCB ground and frame ground, so that when the plug-type connector 1 and the receptacle-type connector 20 are coupled, the shells 3 of the plug-type connector 1 mate with the PCB-grounded shells 3' of the receptacle-type connector 20 and are electrically connected for PCB grounding, and the frame body 7 of the plug-type connector 1 mates with the frame-grounded frame body 7' of the receptacle-type connector 20 and is electrically connected for frame grounding.

Additionally, in the plug-type connector 1, the frame body 7 is electrically connected to the shell 3 via the resilient protruding piece 16, the arcuate portion 15 and the braiding 8, enabling a grounding format which incorporates both PCB grounding and frame grounding to be achieved.

However, FIG. 4 shows an example in which there are four paired lines inside the communication cable 2, but in FIG. 9, they are shown as a single collective body.

Furthermore, while FIG. 9 appears to show the shells 3, 3' in contact with the contacts 21 or the electrical lines or contacts 30, they are not electrically connected.

Example 2

Example 2 will demonstrate an embodiment wherein all the communication cables are only PCB grounded.

In Example 2, the arcuate portions 15 of the lower clip 4 used in the plug-type connector of FIG. 5B are all detached. When the clips 4 with all of the arcuate portions 15 detached are respectively mounted on corresponding resin blocks 5, the surfaces of the concave portions of the resin block 5 are exposed at the respective opposing concave portions 12 shown in FIG. 5A due to the fact that the arcuate portions 15 are missing.

Consequently, the section view along X-X' in all the concave portions 12 with the arcuate portions 15 of FIG. 5A detached is in a state wherein the arcuate portions 15 are not present in FIG. 5C.

In FIG. 6B, when each communication cable 2 is clamped between a pair of resin blocks 5, the braiding 8 is pressed into contact with the surface of the concave portion of the resin block 5 at all the concave portions 12, thereby enabling only a PCB ground to be formed by a reliable electrical connection between the braiding 8 and the shells 3, while the shells 3 and braiding 8 are not electrically connected to the frame body 7 which is to be frame grounded.

Figure 10:
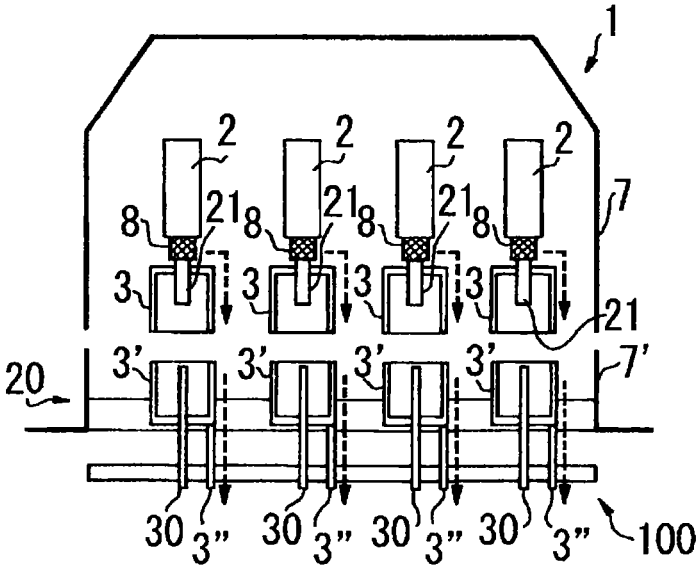
FIG. 10 is a schematic plan view showing the grounding format of Example 2.

FIG. 10 is a schematic plan view of an example of an embodiment of Example 2, which is a section view similar to that of FIG. 9, showing a grounding format in a plug-type connector wherein all of the communication cables 2 are only PCB grounded.

However, while FIG. 4 shows an example where there are four electrical lines inside the communication cable 2, they are represented as a single collective body in FIG. 10.

Additionally, while the right-most arcuate portion 15 of the clip 4 of the plug-type connector 1 is detached in FIG. 5B, all of the arcuate portions 15 are detached in FIG. 10.

Furthermore, while the drawing appears to show the shells 3, 3' in contact with the contacts 21 or the electrical lines or contacts 30, they are not electrically connected.

In FIG. 10, the receptacle-type connector 20 on the substrate 100 side of Example 2 has the same structure as the receptacle-type connector on the substrate side of Example 1.

As a result, when the plug-type connector 1 and the receptacle-type connector 20 are coupled, the braiding 8 which forms the ground line for all communication cables 2 is connected to the ground line of the PCB through the shells 3 and 3' as indicated by the dashed arrows, so that all of the communication cables 2 are PCB grounded but not frame grounded.

Example 3

Example 3 will demonstrate an embodiment wherein all of the communication cables 2 of the plug-type connector are only frame grounded.

In Example 3, the arcuate portions 15 are not detached as in the upper clip 4 in FIG. 5B. When these clips 4 in which the arcuate portions 15 are not detached are respectively mounted on the resin blocks 5, the surfaces of the arcuate portions 15 are exposed at the respective opposing concave portions 12 shown in FIG. 5A.

In FIG. 6B, when the respective communication cables 2 are clamped between a pair of resin blocks 5, the braiding 8 is pressed into contact by the force of resilience of the arcuate portions 15 of the clips 4 in all of the concave portions 12, so the braiding 8 electrically connects with the frame body 7 through the arcuate portions 15 and is frame grounded through the frame body 7'.

Figure 11:
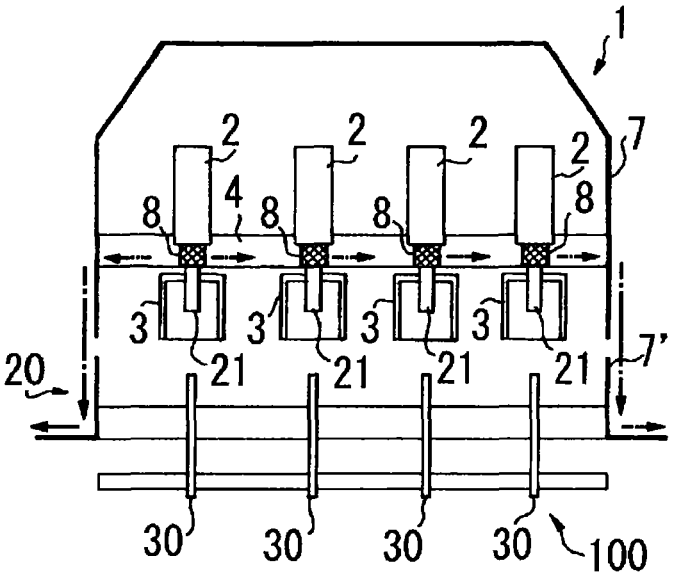
FIG. 11 is a schematic plan view showing the grounding format of Example 3.

FIG. 11 is a schematic plan view of an example of an embodiment of Example 3, which is a section view similar to that of FIG. 9, showing a grounding format in a plug-type connector wherein all of the communication cables 2 are only frame grounded.

However, while FIG. 4 shows an example where there are four electrical lines inside the communication cable 2, they are represented as a single collective body in FIG. 11.

Additionally, while the drawing appears to show the shells 3, 3' in contact with the contacts 21, they are not electrically connected.

In FIG. 11, the receptacle-type connector 20 on the substrate 100 side of Example 3 does not have shells 3' corresponding to the shells 3 of the plug-type connector 1 for any of the communication cables 2.

As a result, when the plug-type connector 1 and the receptacle-type connector 20 are coupled, the braiding 8 which forms the ground line for all communication cables 2 is frame grounded through the frame bodies 7 and 7' as indicated by the dashed arrows, so that all of the communication cables 2 are frame grounded but not PCB grounded.

In this case, it is possible to not have PCB grounding even if there are shells 3', by detaching and removing 3" from the shells 3', by not electrically connecting them with the ground line of the PCB by solder or the like, or by arranging the ground line of the PCB so as not to contact the ground line on the PCB side.

Example 4

Example 4 will demonstrate an embodiment wherein the communication cables 2 are neither PCB grounded nor frame grounded.

In Example 4, all of the arcuate portions 15 on the lower clip 4 used in the plug-type connector of FIG. 5B are detached. When the clips 4 having all of the arcuate portions 15 detached are respectively mounted on corresponding resin blocks 15, the surfaces of the concave portions of the resin blocks 5 will be exposed because the arcuate portions 15 are missing at each of the opposing concave portions 12 shown in FIG. 5A.

As a result, the cross section at X-X' of all of the concave portions 12 with the arcuate portions 15 detached in FIG. 5A are in a state missing the arcuate portions 15 in FIG. 5C.

In FIG. 6B, when the respective communication cables 2 are clamped by a pair of resin blocks 5, the braiding 8 and the frame body 7 will not be electrically connected due to the absence of the arcuate portions 15 at all of the concave portions 12, so that there will be no frame grounding.

Figure 12:
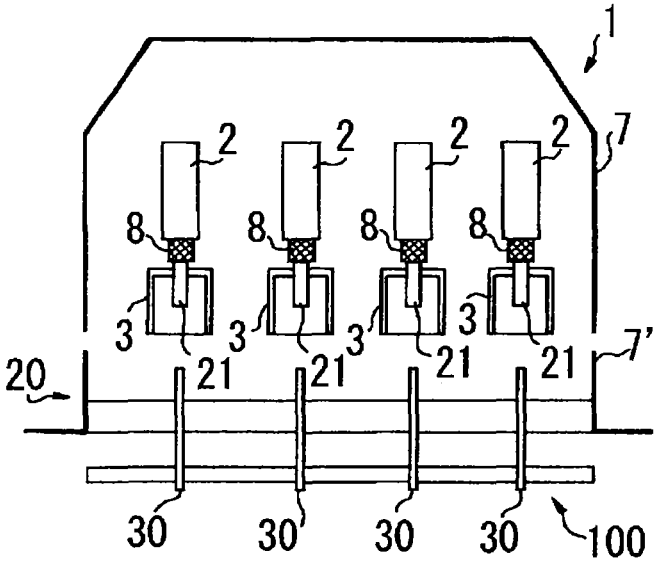
FIG. 12 is a schematic plan view showing the grounding format of Example 4.

FIG. 12 is a schematic plan view of an example of an embodiment of Example 4, which is a section view similar to that of FIG. 9, showing a grounding format in a plug-type connector wherein none of the communication cables 2 are PCB grounded or frame grounded.

The receptacle-type connector 20 on the substrate 100 side of FIG. 12 does not have shells 3' corresponding to the shells 3 on the plug-type connector 1 for any of the communication cables 2. As a result, there is no PCB grounding.

In this case, it is possible to not have PCB grounding even if shells 3' are provided, by detaching and removing 3" from the shells 3', by not electrically connecting them with the ground line of the PCB by solder or the like, or by arranging the ground line of the PCB so as not to contact the ground line on the PCB side.

As a result, there is neither PCB grounding nor frame grounding in Example 4.

Example 5

Example 5 will demonstrate an embodiment wherein some of the communication cables 2 are PCB grounded, and the other communication cables 2 are frame grounded, so that each communication cable 2 is separately grounded.

Referring to the lower clip 4 used in the plug-type connector of FIG. 5B, the right-most arcuate portion 15 is detached. When a pair of these lower clips 4 are respectively mounted onto corresponding resin blocks 5, the surfaces of the concave portions of the resin blocks 5 will be exposed due to the detachment of the arcuate portions 15 at the opposing concave portions 12 which are positioned right-most in FIG. 5A.

As a result, the cross section at X-X' of the concave portions 12 with the arcuate portions 15 detached in FIG. 5A are in a state missing the arcuate portions 15 in FIG. 5C.

In FIG. 6B, when the respective communication cables 2 are clamped between a pair of resin blocks 5, at the concave portions with the arcuate portions 15 detached, the braiding 8 is pressed into contact with the surface of the concave portion of the resin block 5, thereby providing only PCB grounding by a reliable electrical connection between the braiding 8 and the shell 3, while the shell 3 and braiding 8 are not electrically connected to the frame body 7.

Figure 13:
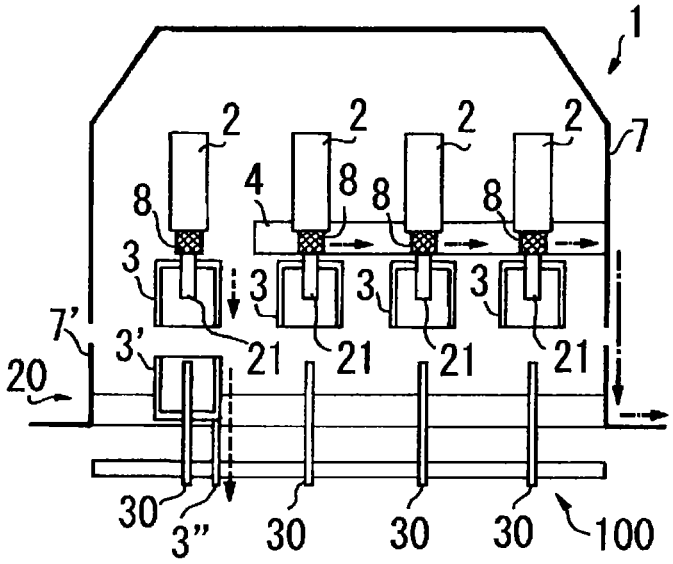
FIG. 13 is a schematic plan view showing the grounding format of Example 5.

FIG. 13 is a schematic plan view of an example of an embodiment of Example 5, which is a section view similar to that of FIG. 9, showing a grounding format in a plug-type connector wherein one of the communication cables 2 is PCB grounded and the other communication cables 2 are frame grounded.

However, while FIG. 4 shows an example where there are four electrical lines inside the communication cable 2, they are represented as a single collective body in FIG. 13.

Additionally, in FIG. 5A to FIG. 5C, the right-most arcuate portions 15 in the clips 4 of the plug-type connector 1 are detached, while in FIG. 13, a pair of such clips is used and arranged so that the left-most arcuate portions 15 are detached.

Furthermore, while FIG. 13 appears to show the shells 3, 3' in contact with the contacts 21, they are not electrically connected.

In FIG. 13, the receptacle-type connector 20 on the substrate 100 side of Example 5 does not have shells 3' corresponding to the shells 3 installed on the three communication cables 2 that are frame grounded, for which the arcuate portions 15 of the plug-type connector 1 are not detached.

As a result, when a plug-type connector 1 and a receptacle-type connector 20 are coupled, the braiding 8 forming the ground line for the left-most communication cable 2 is connected to the ground line of the substrate through the shell 3 and the shell 3' as indicated by the dashed arrows, thereby providing PCB grounding.

On the other hand, the braiding of the other communication cables is electrically connected respectively to the frame bodies 7 and 7' as indicated by the single-dotted chain arrows to provide frame grounding, but no corresponding shells 3' are provided on the receptacle-type connector 20 side, so that there is no PCB grounding.

In this case, it is possible to not have PCB grounding even if there are shells 3', by detaching and removing 3" from the shells 3', by not electrically connecting them with the ground line of the PCB by solder or the like, or by arranging the ground line of the PCB so as not to contact the ground line on the PCB side.

While embodiments of the present invention have been described by giving examples above, the present invention is not limited to the above-described examples, and appropriate additions or modifications can be made within the scope of the gist of the present invention.

For example, as modification examples of Examples 1-4, the design can be changed as to whether or not to detach the arcuate portions 15 in the clips 4 of the plug-type connector 1 or whether or not to provide shells 3' on the receptacle-type connector depending on the communication cable 2, and for any communication cable 2, it may be possible to choose between only PCB grounding, only frame grounding, a grounding format electrically connecting both forms of grounding, or grounding formats with neither type of grounding.

Additionally, while Examples 1 to 4 used resin blocks 5, the plate-shaped base portions could be made thicker to raise their ability to secure the cables, enabling the resin blocks 5 to be omitted.

Furthermore, while a format in which the communication cables 2 are arranged in the width direction was described, the arrangement could have a plurality of stages arranged in a vertical direction.

Furthermore, in Examples 2, 4 and 5, the surfaces of the concave portions of the resin blocks with the arcuate portions 15 detached were pressed against the braiding 8, but the braiding 8 could be made not to contact the resin blocks 5, and any configuration can be included in the scope of the present invention as long as the clip 4 and the braiding 8 are not electrically connected and there is no frame grounding.

Furthermore, Examples 3 to 5 described embodiments that are not PCB grounded due to not providing second shells 3' on the receptacle-side connector 20, but the structure may be such that there is no PCB grounding due to removal of the ground lines 3" of the second shells 3' so that they are not electrically connected to the ground line of the PCB, or by not soldering so that the ground lines 3" are not electrically connected to the ground line of the PCB.

INDUSTRIAL APPLICABILITY

The connector according to the present invention can be used in the technical field of connectors for electrically connecting communication devices.

DESCRIPTION OF REFERENCE NUMBERS

1 plug-type connector
2 communication cable

3 shell of plug-type connector
3' shell of receptacle-type connector
3" ground line of shell of receptacle-type connector
4 clip of plug-type connector
5 resin block of plug-type connector
6 plug body of receptacle-type connector
7*a* portion of plug-type connector frame body
7*b* portion of plug-type connector frame body
7' frame body of receptacle-type connector
8 braiding of communication cable
9 insulating insert
10 securing portion of shell
11 peripheral portion of shell
12 concave portion
13 plate-shaped base portion of clip
14 extension portion of clip
15 arcuate portion of clip
16 resilient protruding piece of clip
17 claw portion of resin block
18 outer skin of communication cable
19 assembly
20 receptacle-type connector
21 contact of plug-type connector
30 electrical line or contact of receptacle-type connector
50 metallic rack
100 substrate

The invention claimed is:

1. A connector capable of securing in a row a plurality of cables comprising a conductor line and a grounding conductor portion covering an outside portion of the conductor line, the connector comprising:

a first conductive shell covering the conductor line without electrical contact and contacting the grounding conductor portion;

a conductive member comprising:

a plate-shaped base portion, a plurality of contact portions detachably conjoined to an edge portion of the base portion, and covering and contacting the grounding conductor portion of each cable, and a protruding piece extending from a surface of the base portion; and a conductive first frame body arranged to cover the conductive member and the first conductive shell;

wherein the first frame body is electrically connected to the first conductive shell via the protruding piece, the contact portions and the grounding conductor portion.

2. A pair of connectors comprising the connector according to claim 1, and a counterpart connector corresponding thereto, wherein all of the contact portions are detached from the base portion; and when the pair of connectors is coupled, the first conductive shell is electrically connected to a ground line in a substrate by coming into contact with a second conductive shell provided on the counterpart connector that mates with the first conductive shell.

3. A pair of connectors comprising the connector according to claim 1, and a counterpart connector corresponding thereto, wherein the first frame body, by coming into contact with a second frame body provided on the counterpart connector, is electrically connected to a ground line different from the ground line in the substrate connected to the second frame body; and when the pair of connectors is coupled, the first conductive shell is not electrically connected to the ground line in the substrate due to not providing the second conductive shell in the counterpart connector mating with the first conductive shell, or removing the ground line of the second conductive shell.

4. A pair of connectors comprising the connector according to claim 1, and a counterpart connector corresponding thereto, wherein all of the contact portions are detached from the base portion; and when the pair of connectors is coupled, the first conductive shell is not electrically connected to the ground line in the substrate due to not providing the second conductive shell in the counterpart connector mating with the first conductive shell, or removing the ground line of the second conductive shell.

5. The connector according to claim 1, wherein when an arbitrary contact portion is detached from the base portion, a first conductive shell corresponding to the arbitrary contact portion is not electrically connected with the first frame body.

6. A pair of connectors comprising the connector according to claim 5, and a counterpart connector corresponding thereto, wherein all of the contact portions are detached from the base portion; and when the pair of connectors is coupled, the first conductive shell is electrically connected to a ground line in a substrate by coming into contact with a second conductive shell provided on the counterpart connector that mates with the first conductive shell.

7. A pair of connectors comprising the connector according to claim 5, and a counterpart connector corresponding thereto, wherein the first frame body, by coming into contact with a second frame body provided on the counterpart connector, is electrically connected to a ground line different from the ground line in the substrate connected to the second frame body; and when the pair of connectors is coupled, the first conductive shell is not electrically connected to the ground line in the substrate due to not providing the second conductive shell in the counterpart connector mating with the first conductive shell, or removing the ground line of the second conductive shell.

8. A pair of connectors comprising the connector according to claim 5, and a counterpart connector corresponding thereto, wherein all of the contact portions are detached from the base portion; and when the pair of connectors is coupled, the first conductive shell is not electrically connected to the ground line in the substrate due to not providing the second conductive shell in the counterpart connector mating with the first conductive shell, or removing the ground line of the second conductive shell.

9. The connector according to claim 5, wherein the conductive member is attached to a non-conductive member for securing each cable, and when the contact portion is detached, the non-conductive member presses against the grounding conductor portion so as to electrically connect the grounding conductor portion and the first conductive shell.

10. A pair of connectors comprising the connector according to claim 9, and a counterpart connector corresponding thereto, wherein all of the contact portions are detached from the base portion; and when the pair of connectors is coupled, the first conductive shell is electrically connected to a ground line in a substrate by coming into contact with a second conductive shell provided on the counterpart connector that mates with the first conductive shell.

11. A pair of connectors comprising the connector according to claim 9, and a counterpart connector corresponding thereto, wherein the first frame body, by coming into contact with a second frame body provided on the counterpart connector, is electrically connected to a ground line different from the ground line in the substrate connected to the second frame body; and when the pair of connectors is coupled, the first conductive shell is not electrically connected to the ground line in the substrate due to not providing the second conductive shell in the counterpart connector mating with the first conductive shell, or removing the ground line of the second conductive shell.

12. A pair of connectors comprising the connector according to claim 9, and a counterpart connector corresponding thereto, wherein all of the contact portions are detached from the base portion; and when the pair of connectors is coupled, the first conductive shell is not electrically connected to the ground line in the substrate due to not providing the second conductive shell in the counterpart connector mating with the first conductive shell, or removing the ground line of the second conductive shell.

13. A connector capable of securing in a row one or more cables comprising a conductor line and a grounding conductor portion covering an outside portion of the conductor line, the connector comprising:

a conductive shell covering the conductor line without electrical contact and contacting the grounding conductor portion;

a conductive member comprising:

a plate-shaped base portion, one or more contact portions detachably conjoined to an edge portion of the base portion, and covering and contacting the grounding conductor portion of each cable, and a protruding piece extending from a surface of the base portion; and a conductive first frame body arranged to cover the conductive member and the conductive shell;

wherein the frame body is electrically connected to the conductive shell via the protruding piece, the contact portion and the grounding conductor portion.

* * * * *